US006438518B1

(12) United States Patent
Manjunath et al.

(10) Patent No.: US 6,438,518 B1
(45) Date of Patent: Aug. 20, 2002

(54) METHOD AND APPARATUS FOR USING CODING SCHEME SELECTION PATTERNS IN A PREDICTIVE SPEECH CODER TO REDUCE SENSITIVITY TO FRAME ERROR CONDITIONS

(75) Inventors: Sharath Manjunath; Andrew P. Dejaco; Arasanipalai K. Ananthapadmanabhan; Eddie Lun Tik Choy, all of San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/429,754

(22) Filed: Oct. 28, 1999

(51) Int. Cl.[7] ..... G10L 19/04; G10L 19/08; G10L 19/10; G10L 19/12

(52) U.S. Cl. ..... 704/219; 704/221; 704/236; 704/243; 704/262

(58) Field of Search ..... 704/200–201, 704/208, 214, 219–223, 262

(56) References Cited

U.S. PATENT DOCUMENTS

| | | | | |
|---|---|---|---|---|
| 5,414,796 A | | 5/1995 | Jacobs et al. | 395/2.3 |
| 5,483,619 A | * | 1/1996 | Blanchard | 704/262 |
| 5,596,676 A | * | 1/1997 | Swaminathan et al. | 704/208 |
| 5,602,961 A | * | 2/1997 | Kolesnik et al. | 704/223 |
| 5,659,659 A | * | 8/1997 | Kolesnik et al. | 704/219 |
| 5,727,123 A | | 3/1998 | McDonough et al. | 395/2.33 |
| 5,911,128 A | * | 6/1999 | DeJaco | 704/214 |
| 6,058,359 A | * | 5/2000 | Hagen et al. | 704/214 |
| 6,064,954 A | * | 5/2000 | Cohen et al. | 704/219 |

FOREIGN PATENT DOCUMENTS

EP 0718820 A2 6/1996

OTHER PUBLICATIONS

Zarrinkoub et al ("Switched Prediction and Quantization of LSP frequencies," 1996 IEEE ICASP, May 7–10, 1996).*

Zarrinkoub et al ("LPC Requirments for the GPP–CELP Coder," 1999 IEEE Workshop, Jun. 20–23, 1999).*

A. Das, El et al, "Multimode Variable Bit Rate Speech Coding: An Efficient Paradigm for High–Quality Low–Rate Representation of Speech Signal," 1999 IEEE Internatioal Conference on Acoustics, Speech, and Signal Processing, Phoenx, Arizona, USA. Mar. 15–19, 1999, vol. 4, pp. 2307–2310.

Rabiner, et al. "Linear Predictive Coding of Speech" *Digital Processing of Speech Signals*, Prentice Hall, editors (pp. 396–461) 1978.

* cited by examiner

*Primary Examiner*—Richemond Dorvil
*Assistant Examiner*—Daniel A. Nolan
(74) *Attorney, Agent, or Firm*—Philip Wadsworth; Kent D. Baker; Kyong H. Macek

(57) ABSTRACT

A method and apparatus for using coding scheme selection patterns in a predictive speech coder to reduce sensitivity to frame error conditions includes a speech coder configured to select from among various predictive coding modes. After a predefined number of speech frames have been predictively coded, the speech coder codes one frame with a nonpredictive coding mode or a mildly predictive coding mode. The predefined number of frames can be determined in advance from the subjective standpoint of a listener. The predefined number of frames may be varied periodically. An average coding bit rate may be maintained for the speech coder by ensuring that an average coding bit rate is maintained for each successive pattern, or group, of predictively coded speech frames including at least one nonpredictively coded or mildly predictively coded speech frame.

33 Claims, 7 Drawing Sheets

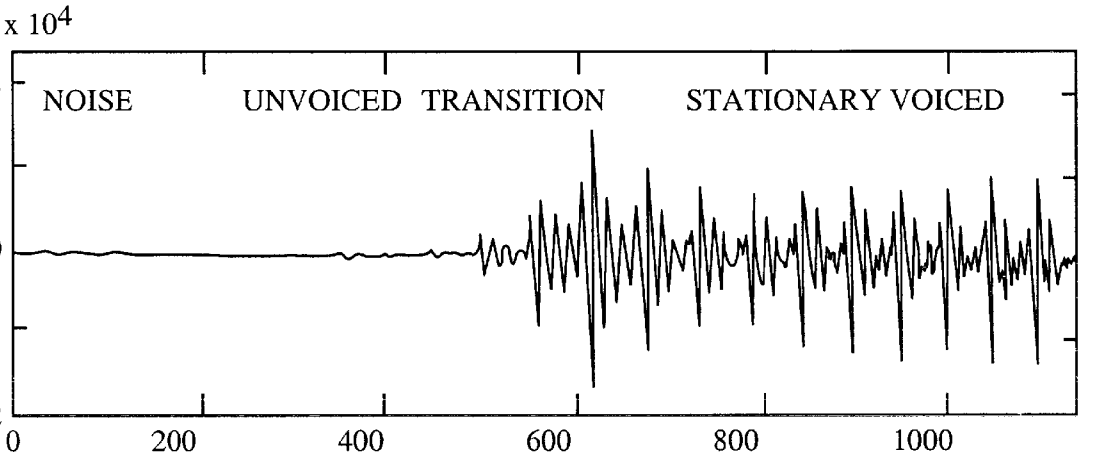
FIG. 5A
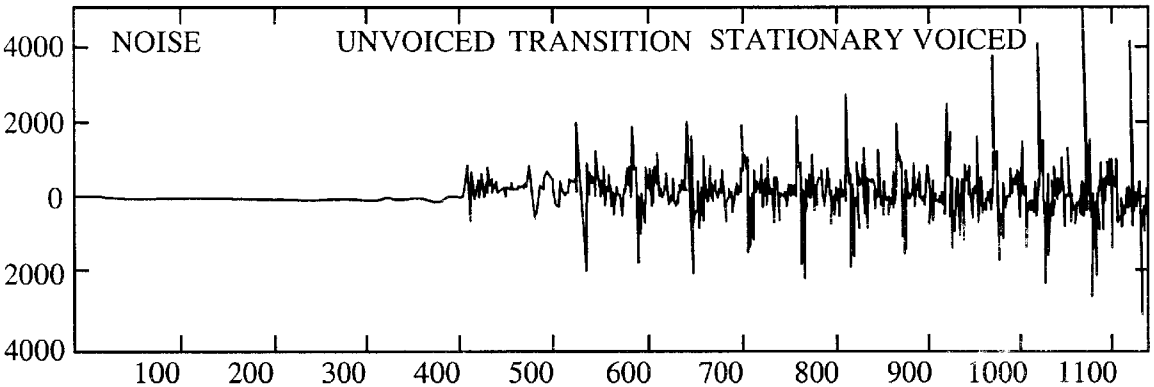
FIG. 5B
FIG. 5
PRIOR ART

METHOD AND APPARATUS FOR USING CODING SCHEME SELECTION PATTERNS IN A PREDICTIVE SPEECH CODER TO REDUCE SENSITIVITY TO FRAME ERROR CONDITIONS

BACKGROUND OF THE INVENTION

I. Field of the Invention

The present invention pertains generally to the field of speech processing, and more specifically to methods and apparatus for reducing sensitivity to frame error conditions in predictive speech coders.

II. Background

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) is required to achieve a speech quality of a conventional analog telephone. However, through the use of speech analysis, followed by the appropriate coding, transmission, and resynthesis at the receiver, a significant reduction in the data rate can be achieved.

Devices that employ techniques to compress speech by extracting parameters that relate to a model of human speech generation are called speech coders. A speech coder divides the incoming speech signal into blocks of time, or analysis frames. Speech coders typically comprise an encoder and a decoder. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, unquantizes them to produce the parameters, and resynthesizes the speech frames using the unquantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on: (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Perhaps most important in the design of a speech coder is the search for a good set of parameters (including vectors) to describe the speech signal. A good set of parameters requires a low system bandwidth for the reconstruction of a perceptually accurate speech signal. Pitch, signal power, spectral envelope (or formants), amplitude and phase spectra are examples of the speech coding parameters.

Speech coders may be implemented as time-domain coders, which attempt to capture the time-domain speech waveform by employing high time-resolution processing to encode small segments of speech (typically 5 millisecond (ms) subframes) at a time. For each subframe, a high-precision representative from a codebook space is found by means of various search algorithms known in the art. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques described in A. Gersho & R. M. Gray, *Vector Quantization and Signal Compression* (1992).

A well-known time-domain speech coder is the Code Excited Linear Predictive (CELP) coder described in L. B. Rabiner & R. W. Schafer, *Digital Processing of Speech Signals* 396–453 (1978), which is fully incorporated herein by reference. In a CELP coder, the short term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, $N_0$, for each frame) or at a variable rate (in which different bit rates are used for different types of frame contents). Variable-rate coders attempt to use only the amount of bits needed to encode the codec parameters to a level adequate to obtain a target quality. An exemplary variable rate CELP coder is described in U.S. Pat. No. 5,414,796, which is assigned to the assignee of the present invention and fully incorporated herein by reference.

Time-domain coders such as the CELP coder typically rely upon a high number of bits, $N_0$, per frame to preserve the accuracy of the time-domain speech waveform. Such coders typically deliver excellent voice quality provided the number of bits, $N_0$, per frame are relatively large (e.g., 8 kbps or above). However, at low bit rates (4 kbps and below), time-domain coders fail to retain high quality and robust performance due to the limited number of available bits. At low bit rates, the limited codebook space clips the waveform-matching capability of conventional time-domain coders, which are so successfully deployed in higher-rate commercial applications. Hence, despite improvements over time, many CELP coding systems operating at low bit rates suffer from perceptually significant distortion typically characterized as noise.

There is presently a surge of research interest and strong commercial need to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth, and a low-rate speech coder coupled with an additional layer of suitable channel coding can fit the overall bit-budget of coder specifications and deliver a robust performance under channel error conditions. An exemplary low-rate speech coder is the prototype pitch period (PPP) speech coder described in U.S. application Ser. No. 09/217,341, entitled VARIABLE RATE SPEECH CODING, filed Dec. 21, 1998, assigned to the assignee of the present invention, and fully incorporated herein by reference.

In conventional predictive speech coders such as the CELP coder, the PPP coder, and the waveform interpolation (WI) coder, the coding scheme relies heavily upon past output. Hence, if a frame error or a frame erasure is received at the decoder, the decoder must create its own best replacement for the frame in question. The decoder typically uses an intelligent frame repeat of the previous output. Because the decoder must create its own replacement, the decoder and the encoder lose synchronization with each other. Therefore, when the next frame arrives at the decoder, if that frame is predictively coded, the decoder refers to different previous output than the encoder used. This causes a reduction in voice quality or speech coder performance. The more heavily the speech coder relies on predictive coding techniques (i.e., the more frames the speech coder encodes predictively), the greater the reduction in performance. Thus, there is a need for a method of reducing sensitivity to frame error conditions in a predictive speech coder.

SUMMARY OF THE INVENTION

The present invention is directed to a method of reducing sensitivity to frame error conditions in a predictive speech coder. Accordingly, in one aspect of the invention, a speech coder is provided. The speech coder advantageously includes at least one predictive coding mode; at least one less-predictive coding mode; and a processor coupled to the at least one predictive coding mode and to the at least one less-predictive coding mode, the processor being configured to cause successive speech frames to be coded by selected coding modes in accordance with a pattern of coded speech frames, the pattern including at least one speech frame coded with the less-predictive coding mode.

In another aspect of the invention, a method of coding speech frames is provided. The method advantageously includes the steps of coding a predefined number of successive speech frames with a predictive coding mode; coding at least one speech frame with a less-predictive coding mode after performing the step of coding a predefined number of successive speech frames with a predictive coding mode; and repeating the two coding steps in order to generate a plurality of speech frames coded in accordance with a pattern.

In another aspect of the invention, a speech coder is provided. The speech coder advantageously includes means for coding a predefined number of successive speech frames with a predictive coding mode; means for coding at least one speech frame with a less-predictive coding mode after the predefined number of successive speech frames have been coded with the predictive coding mode; and means for generating a plurality of speech frames coded in accordance with a pattern, the pattern including at least one speech frame coded with a less-predictive coding mode.

In another aspect of the invention, a method of coding speech frames is provided. The method advantageously includes the step of coding a plurality of speech frames in a pattern, the pattern including at least one predictively coded speech frame and at least one less-predictively coded speech frame.

In another aspect of the invention, a method of coding speech frames is provided. The method advantageously includes the step of coding a plurality of speech frames in a pattern, the pattern including at least one heavily predictively coded speech frame and at least one mildly predictively coded speech frame.

BRIEF DESCRIPTION OF THE DRAWINGS

FIG. 5A is a graph speech signal amplitude versus time, and

FIG. 5B is a graph of linear prediction (LP) residue amplitude versus time.

DETAILED DESCRIPTION OF THE PREFERRED EMBODIMENTS

Figure 1:
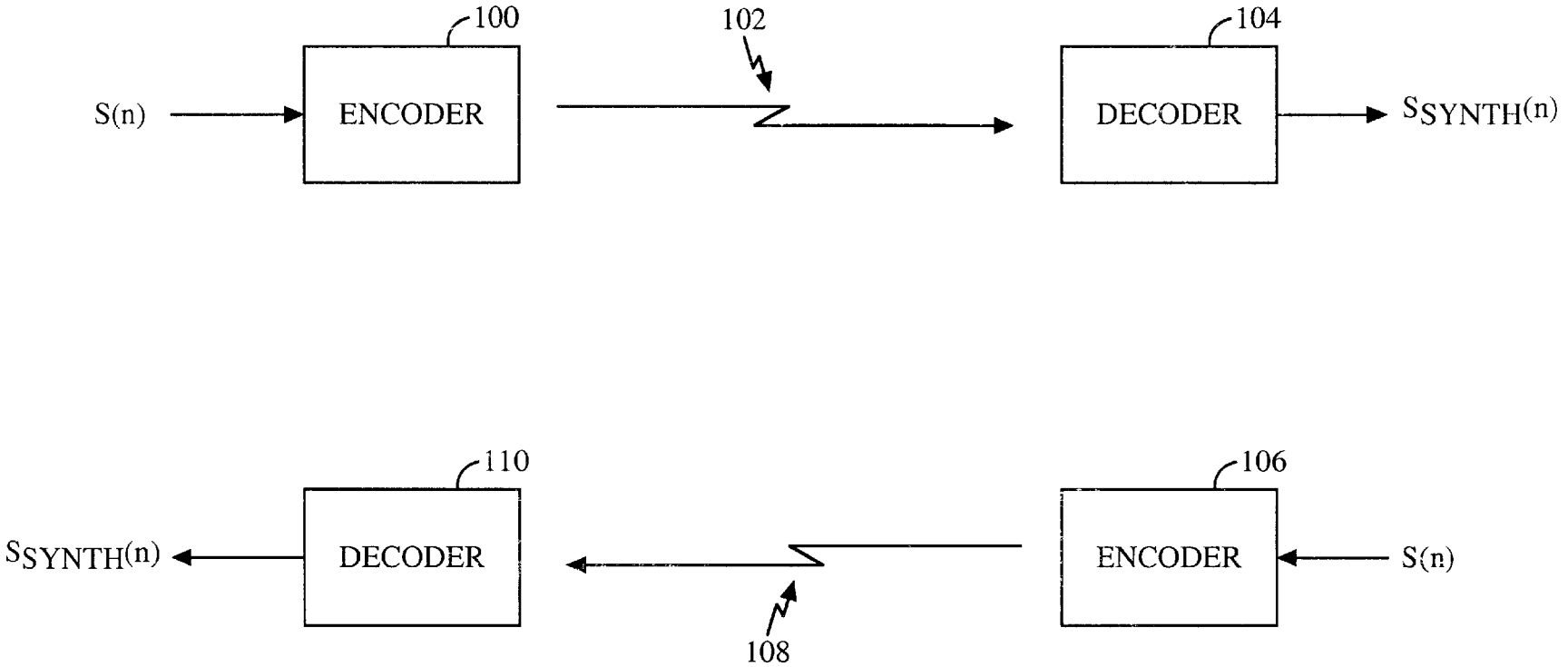
FIG. 1 PRIOR ART
FIG. 1 is a block diagram of a communication channel terminated at each end by speech coders.

In FIG. 1 a first encoder 100 receives digitized speech samples s(n) and encodes the samples s(n) for transmission on a transmission medium 102, or communication channel 102, to a first decoder 104. The transmission medium 102 may be, e.g., a land-based communication line, a link between a base station and a satellite, a wireless communication channel between a cellular or PCS telephone and a base station, or a wireless communication channel between a cellular or PCS telephone and a satellite. The speech samples s(n) are advantageously encoded in the form of various codebook indices and quantized noise, as described below. The decoder 104 decodes the encoded speech samples and synthesizes an output speech signal $s_{SYNTH}(n)$. The decoding process advantageously involves using the transmitted codebook indices to search various codebooks to determine appropriate values to use in synthesizing the output speech signal $s_{SYNTH}(n)$, as described below. For transmission in the opposite direction, a second encoder 106 encodes digitized speech samples s(n), which are transmitted on a communication channel 108. A second decoder 110 receives and decodes the encoded speech samples, generating a synthesized output speech signal $s_{SYNTH}(n)$.

The speech samples s(n) represent speech signals that have been digitized and quantized in accordance with any of various methods known in the art including, e.g., pulse code modulation (PCM), companded m-law, or A-law. As known in the art, the speech samples s(n) are organized into frames of input data wherein each frame comprises a predetermined number of digitized speech samples s(n). The frames may be further subdivided into subframes. In an exemplary embodiment, each frame comprises four subframes. In an exemplary embodiment, a sampling rate of eight kHz is used, with each twenty-ms frame comprising 160 samples. In the embodiments described below, the rate of data transmission may advantageously be varied on a frame-to-frame basis. For example, the rate of data transmission may be varied from full rate to half rate to quarter rate to eighth rate.

Varying the data transmission rate is advantageous because lower bit rates may be selectively employed for frames containing relatively less speech information. As understood by those skilled in the art, various sampling rates, frame sizes, and data transmission rates may be used.

The first encoder 100 and the second decoder 110 together comprise a first speech coder, or speech codec. The speech coder could be used in any communication device for transmitting speech signals, including, e.g., the cellular or PCS telephones, base stations, and/or base station controllers. Similarly, the second encoder 106 and the first decoder 104 together comprise a second speech coder. It is understood by those of skill in the art that speech coders may be implemented with a digital signal processor (DSP), an application-specific integrated circuit (ASIC), discrete gate logic, firmware, or any conventional programmable software module and a microprocessor. The software module could reside in RAM memory, flash memory, registers, or any other form of writable storage medium known in the art. Alternatively, any conventional processor, controller, or state machine could be substituted for the microprocessor. Exemplary ASICs designed specifically for speech coding are described in U.S. Pat. No. 5,727,123, assigned to the assignee of the present invention and fully incorporated herein by reference, and U.S. Pat. No. 5,784,532, assigned to the assignee of the present invention, and fully incorporated herein by reference.

Figure 2:
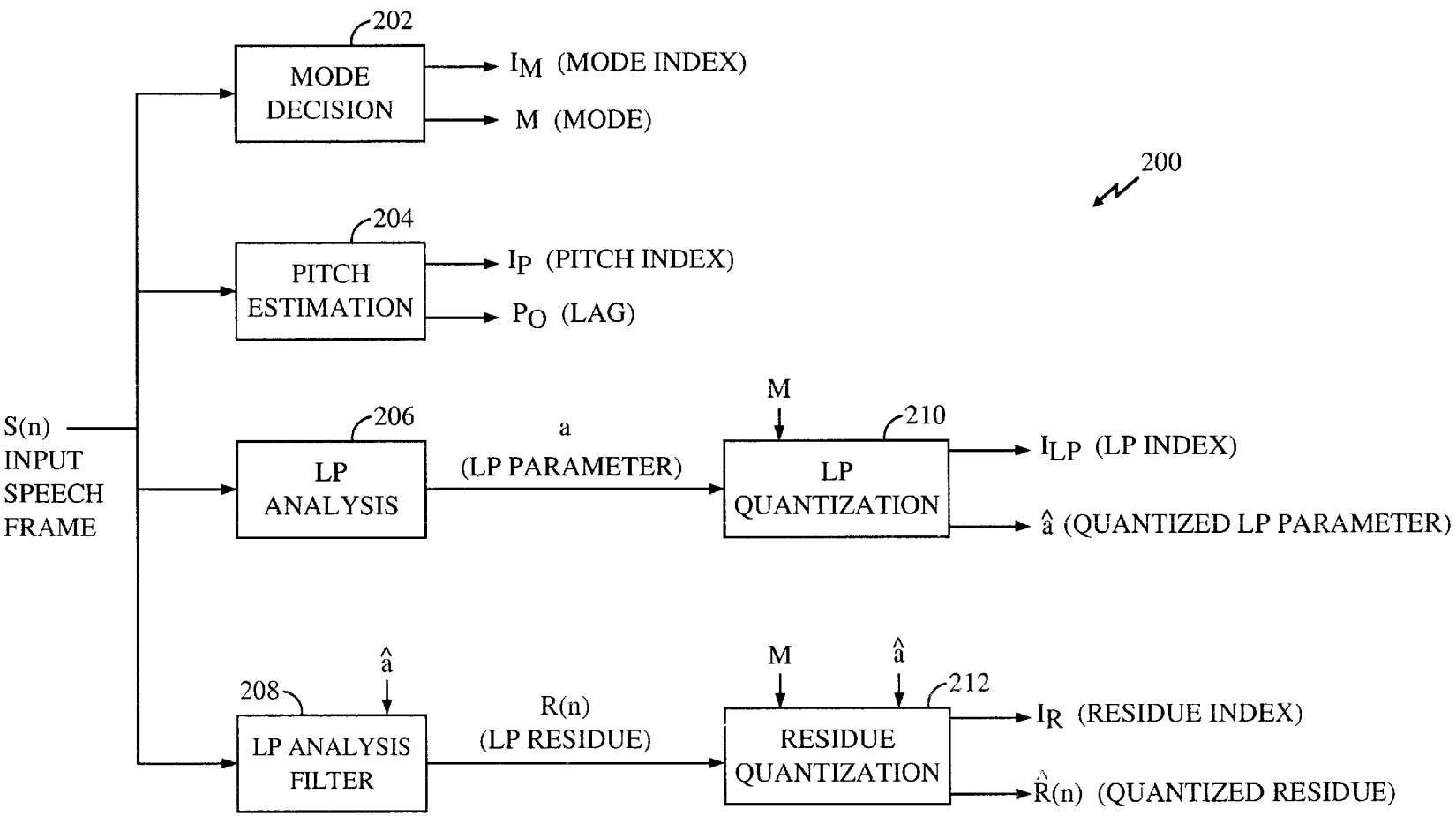
FIG. 2 PRIOR ART
FIG. 2 is a block diagram of an encoder that can be used in the speech coders of FIG. 1.

In FIG. 2 an encoder 200 that may be used in a speech coder includes a mode decision module 202, a pitch estimation module 204, an LP analysis module 206, an LP analysis filter 208, an LP quantization module 210, and a residue quantization module 212. Input speech frames s(n) are provided to the mode decision module 202, the pitch estimation module 204, the LP analysis module 206, and the LP analysis filter 208. The mode decision module 202 produces a mode index $I_M$ and a mode M based upon the periodicity, energy, signal-to-noise ratio (SNR), or zero crossing rate, among other features, of each input speech frame s(n). Various methods of classifying speech frames according to periodicity are described in U.S. Pat. No. 5,911,128, which is assigned to the assignee of the present invention and fully incorporated herein by reference. Such methods are also incorporated into the Telecommunication Industry Association Industry Interim Standards TIA/EIA IS-127 and TIA/EIA IS-733. An exemplary mode decision scheme is also described in the aforementioned U.S. application Ser. No. 09/217,341.

The pitch estimation module 204 produces a pitch index $I_p$ and a lag value $P_o$ based upon each input speech frame s(n). The LP analysis module 206 performs linear predictive analysis on each input speech frame s(n) to generate an LP parameter a. The LP parameter a is provided to the LP quantization module 210. The LP quantization module 210 also receives the mode M, thereby performing the quantization process in a mode-dependent manner. The LP quantization module 210 produces an LP index $I_{LP}$ and a quantized LP parameter â. The LP analysis filter 208 receives the quantized LP parameter â in addition to the input speech frame s(n). The LP analysis filter 208 generates an LP residue signal R[n], which represents the error between the input speech frames s(n) and the reconstructed speech based on the quantized linear predicted parameters â. The LP residue R[n], the mode M, and the quantized LP parameter â are provided to the residue quantization module 212. Based upon these values, the residue quantization module 212 produces a residue index $I_R$ and a quantized residue signal R̂[n].

Figure 3:
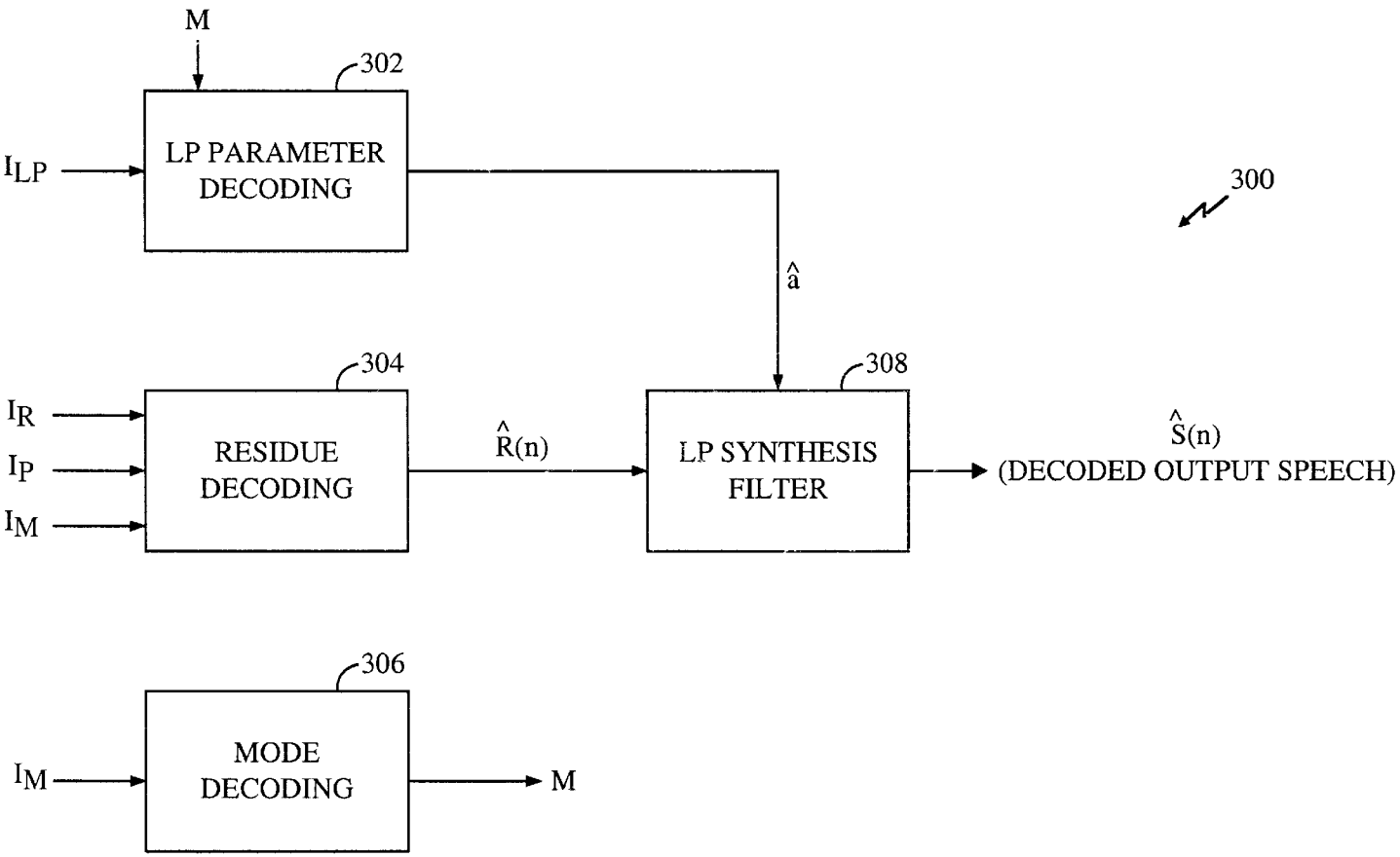
FIG. 3 PRIOR ART
FIG. 3 is a block diagram of a decoder that can be used in the speech coders of FIG. 1.

In FIG. 3 a decoder 300 that may be used in a speech coder includes an LP parameter decoding module 302, a residue decoding module 304, a mode decoding module 306, and an LP synthesis filter 308. The mode decoding module 306 receives and decodes a mode index $I_M$, generating therefrom a mode M. The LP parameter decoding module 302 receives the mode M and an LP index $I_{LP}$. The LP parameter decoding module 302 decodes the received values to produce a quantized LP parameter â. The residue decoding module 304 receives a residue index $I_R$, a pitch index $I_p$, and the mode index $I_M$. The residue decoding module 304 decodes the received values to generate a quantized residue signal R̂[n]. The quantized residue signal R̂[n] and the quantized LP parameter â are provided to the LP synthesis filter 308, which synthesizes a decoded output speech signal ŝ[n] therefrom.

Various operation and implementation techniques for the modules of the encoder 200 of FIG. 2 and the decoder 300 of FIG. 3 are described in the aforementioned U.S. Pat. No. 5,414,796 and U.S. application Ser. No. 09/217,341.

Figure 4:
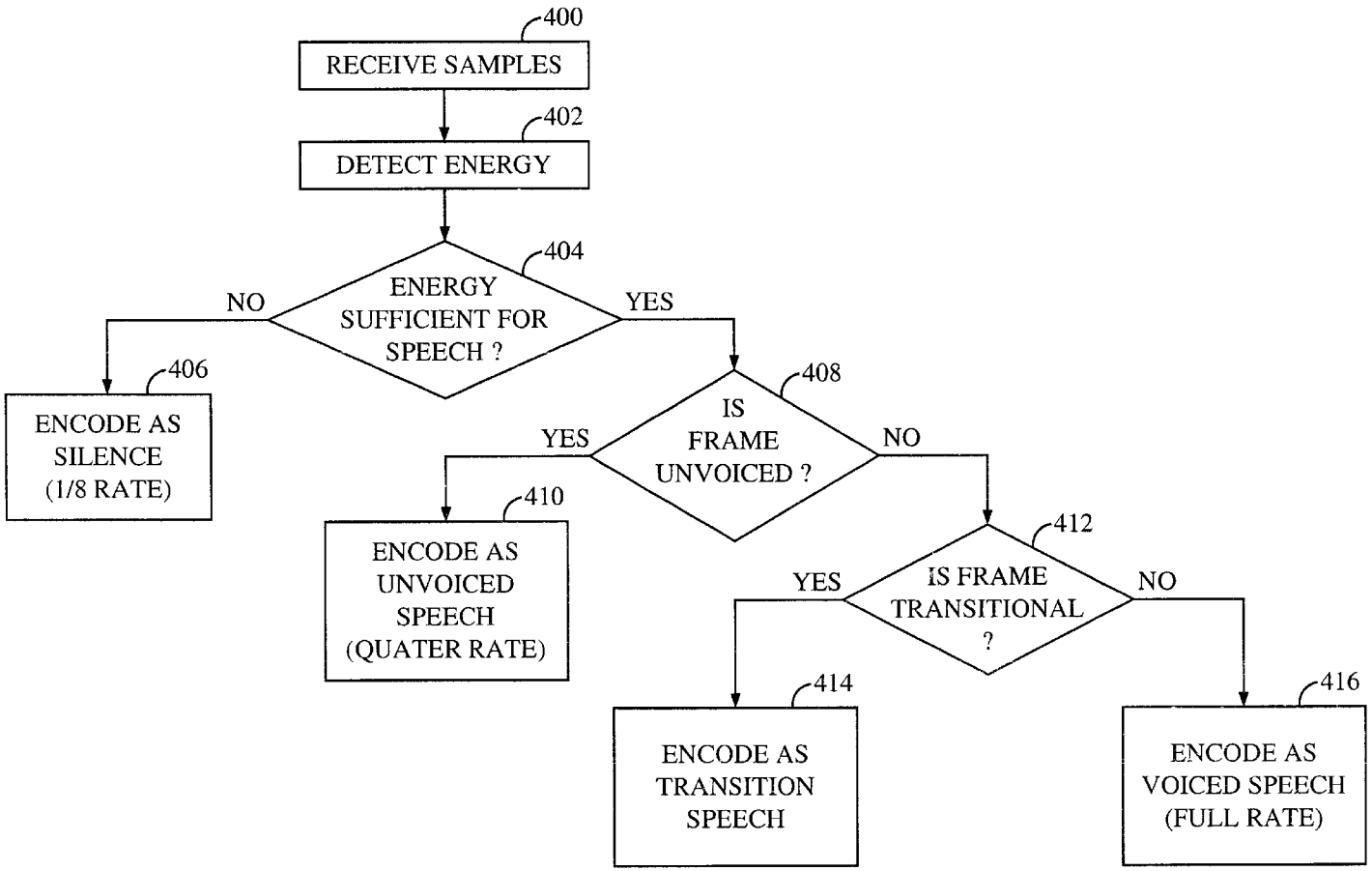
FIG. 4 PRIOR ART
FIG. 4 is a flow chart illustrating a speech coding decision process.

As illustrated in the flow chart of FIG. 4, a speech coder in accordance with one embodiment follows a set of steps in processing speech samples for transmission. In step 400 the speech coder receives digital samples of a speech signal in successive frames. Upon receiving a given frame, the speech coder proceeds to step 402. In step 402 the speech coder detects the energy of the frame. The energy is a measure of the speech activity of the frame. Speech detection is performed by summing the squares of the amplitudes of the digitized speech samples and comparing the resultant energy against a threshold value. In one embodiment the threshold value adapts based on the changing level of background noise. An exemplary variable threshold speech activity detector is described in the aforementioned U.S. Pat. No. 5,414,796. Some unvoiced speech sounds can be extremely low-energy samples that may be mistakenly encoded as background noise. To prevent this from occurring, the spectral tilt of low-energy samples may be used to distinguish the unvoiced speech from background noise, as described in the aforementioned U.S. Pat. No. 5,414,796.

After detecting the energy of the frame, the speech coder proceeds to step 404. In step 404 the speech coder determines whether the detected frame energy is sufficient to classify the frame as containing speech information. If the detected frame energy falls below a predefined threshold level, the speech coder proceeds to step 406. In step 406 the speech coder encodes the frame as background noise (i.e., nonspeech, or silence). In one embodiment the background noise frame is encoded at eighth rate. If in step 404 the detected frame energy meets or exceeds the predefined threshold level, the frame is classified as speech, and the speech coder proceeds to step 408.

In step 408 the speech coder determines whether the frame is unvoiced speech, i.e., the speech coder examines the periodicity of the frame. Various known methods of periodicity determination include, e.g., the use of zero crossings and the use of normalized autocorrelation functions (NACFs). In particular, using zero crossings and NACFs to detect periodicity is described in the aforementioned U.S. Pat. No. 5,911,128 and U.S. application Ser. No. 09/217,341. In addition, the above methods used to distinguish voiced speech from unvoiced speech are incorporated into the Telecommunication Industry Association Interim Standards TIA/EIA IS-127 and TIA/EIA IS-733. If the frame is determined to be unvoiced speech in step 408, the speech coder proceeds to step 410. In step 410 the speech coder encodes the frame as unvoiced speech. In one embodiment unvoiced speech frames are encoded at quarter rate. If in step 408 the frame is not determined to be unvoiced speech, the speech coder proceeds to step 412.

In step 412 the speech coder determines whether the frame is transitional speech, using periodicity detection methods that are known in the art, as described in, e.g., the aforementioned U.S. Pat. No. 5,911,128. If the frame is determined to be transitional speech, the speech coder proceeds to step 414. In step 414 the frame is encoded as transition speech (i.e., transition from unvoiced speech to voiced speech). In one embodiment the transition speech frame is encoded in accordance with a multipulse interpolative coding method described in U.S. Pat. No. 6,260,017, assigned to the assignee of the present invention, and fully incorporated herein by reference. In another embodiment the transition speech frame is encoded at full rate.

If in step 412 the speech coder determines that the frame is not transitional speech, the speech coder proceeds to step 416. In step 416 the speech coder encodes the frame as voiced speech. In one embodiment voiced speech frames may be encoded at half rate. It is also possible to encode voiced speech frames at full rate. Those skilled in the art would appreciate, however, that coding voiced frames at half rate allows the coder to save valuable bandwidth by exploiting the steady-state nature of voiced frames. Further, regardless of the rate used to encode the voiced speech, the voiced speech is advantageously coded using information from past frames, and is hence said to be coded predictively.

Those of skill would appreciate that either the speech signal or the corresponding LP residue may be encoded by following the steps shown in FIG. 4. The waveform characteristics of noise, unvoiced, transition, and voiced speech can be seen as a function of time in the graph of FIG. 5A. The waveform characteristics of noise, unvoiced, transition, and voiced LP residue can be seen as a function of time in the graph of FIG. 5B.

Figure 6:
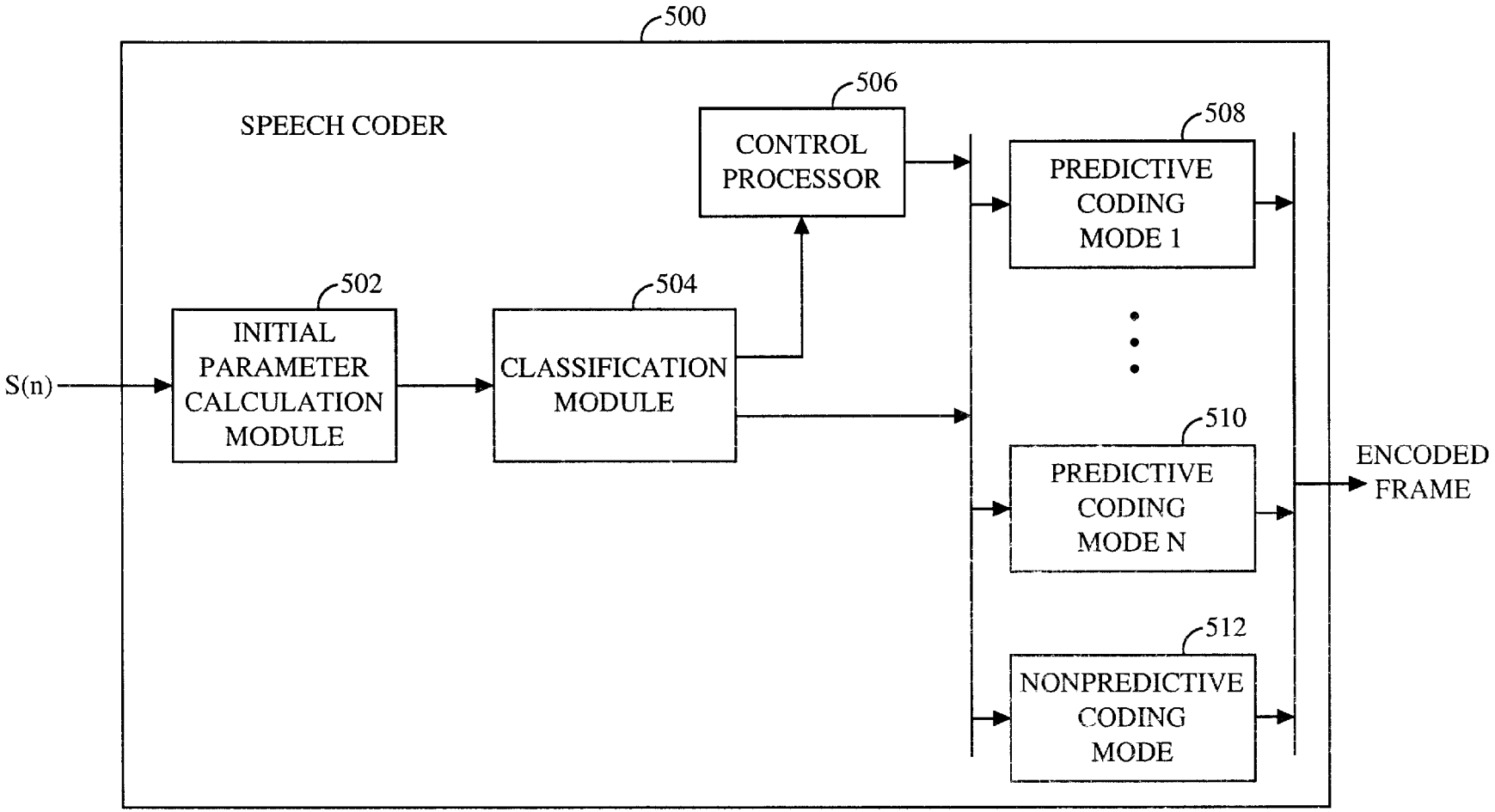
FIG. 6 is a block diagram of a speech coder configured to employ a coding mode selection pattern.

In one embodiment a speech coder 500 that encodes a proportion of frames predictively is configured to reduce sensitivity to frame error conditions by using deterministic coding scheme selection patterns, as shown in FIG. 6. The speech coder 500 includes an initial parameter calculation module 502, a classification module 504, a control processor 506, a plurality, N, of predictive coding modes 508, 510 (for simplicity, only two predictive coding modes 508, 510 are shown, the remaining predictive coding modes being symbolized by a dotted line), and at least one less-predictive coding mode 512. The initial parameter calculation module 502 is coupled to the classification module 504. The classification module 504 is coupled to the control processor 506 and to the various coding modes 508, 510, 512. The control processor is also coupled to the various coding modes 508, 510, 512.

Digitized speech samples s(n) are received by the speech coder 500 and input to the initial parameter calculation module 502. The initial parameter calculation module 502 derives various initial parameters from the speech samples s(n), including, e.g., linear predictive coefficients (LPC coefficients), line spectral pair (LSP) coefficients, normalized autocorrelation functions (NACFs), open-loop lag parameters, band energies, zero crossing rates, and a formant residual signal. The calculation and use of the various initial parameters is known in the art and described in the aforementioned U.S. Pat. No. 5,414,796 and U.S. application Ser. No. 09/217,341.

The initial parameters are provided to the classification module 504. Based upon the initial parameter values, the classification module 504 classifies the speech frame in accordance with the classification steps described above with reference to FIG. 4 The frame classifications are provided to the control processor 506, and the speech frames are provided to the various coding modes 508, 510, 512.

The control processor 506 is advantageously configured to dynamically switch between multiple coding modes 508, 510, 512 from frame to frame, depending on which mode is most appropriate given the properties of the speech for the current frame. A particular coding mode 508, 510, 512 is chosen for each frame to achieve the lowest bit rate available while maintaining acceptable signal reproduction at the decoder (not shown). The bit rate of the speech coder 500 thus changes over time as the properties of the speech signal s(n) change, a process that is referred to as variable-rate speech coding.

In one embodiment the control processor 506 directs the application of a particular predictive coding mode 508, 510 based upon the classification of the current speech frame. One of the predictive coding modes 508, 510 is a CELP coding mode, which is described in the aforementioned U.S. Pat. No. 5,414,796. Another of the predictive coding modes 508, 510 is a PPP coding mode, which is described in the aforementioned U.S. application Ser. No. 0/217,341. Still another predictive coding mode 508, 510 may be a WI coding mode.

In one embodiment the less-predictive coding mode 512 is a mildly predictive, or low-memory, coding scheme. The predictive coding modes 508, 510 may advantageously be heavily predictive coding schemes. In an alternate embodiment, the less-predictive coding mode 512 is a totally nonpredictive, or memoryless, coding scheme. The totally nonpredictive coding mode 512 may be, e.g., a PCM encoding of the speech samples s(n), a companded $\mu$-law encoding of the speech samples s(n), or an A-law encoding of the speech samples s(n).

While one less-predictive coding mode 512 is shown in the embodiment described with reference to FIG. 6, it would be understood by those of skill in the art that more than one less-predictive coding module could be employed. If more than one less-predictive coding module were used, the type of less-predictive coding module could vary. Moreover, in alternate embodiments in which more than one less-predictive coding module is used, some or all of the less-predictive coding modules are mildly predictive coding modules. And in other embodiments, some or all of the less-predictive coding modules are totally nonpredictive coding modules.

In one embodiment the less-predictive coding mode 512 is advantageously inserted by the control processor 506 at deterministic durations. The control processor 506 creates a pattern having a length, F, in frames. In one embodiment the length, F, is based upon the longest tolerable duration of frame error effects. The longest tolerable duration may advantageously be determined in advance from the subjective standpoint of a listener. In another embodiment the length, F, is varied periodically, by the control processor 506. In other embodiments the length, F, is varied either randomly or pseudo-randomly by the control processor 506. An exemplary, recurring pattern is PPPN, where P stands for a predictive coding mode 508, 510, and N denotes the nonpredictive or mildly predictive coding mode 512. In an alternate embodiment, a plurality of less-predictive coding modes are inserted. An exemplary pattern is PPNPPN. In embodiments in which the pattern length, F, is varied, the pattern PPPN might be followed by the pattern PPN, which might be followed by the pattern PPPNPN, etc.

Figure 7:
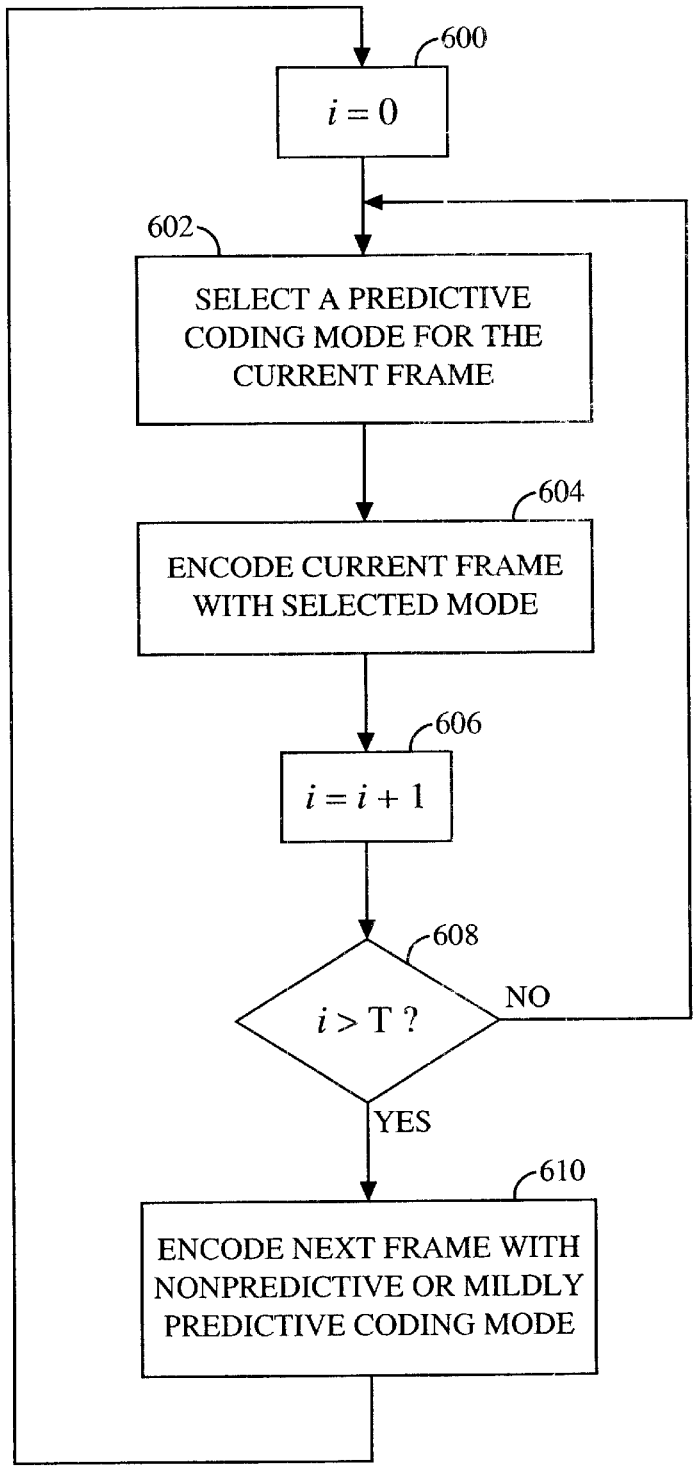
FIG. 7 is a flow chart illustrating method steps performed by a speech coder such as the speech coder of FIG. 8 to employ a coding mode selection pattern.

In one embodiment a speech coder such as the speech coder 500 of FIG. 6 performs the algorithm steps illustrated in the flow chart of FIG. 7 to intelligently insert either a low-memory or a memoryless coding scheme at deterministic intervals. In step 600 the control processor (not shown) sets a count variable, i, equal to zero. The control processor then proceeds to step 602. In step 602 the control processor selects a predictive coding mode for the current speech frame based upon the classification of the speech content of the current frame. The control processor then proceeds to step 604. In step 604 the control processor encodes the current frame with the selected predictive coding mode. The control processor then proceeds to step 606. In step 606 the control processor increments the count variable, i. The control processor then proceeds to step 608.

In step 608 the control processor determines whether the count variable, i, is greater than a predefined threshold value, T. The predefined threshold value, T, may be based upon the longest tolerable duration of frame error effects, as determined in advance from the subjective standpoint of a listener. In a particular embodiment, the predefined threshold value, T, remains fixed for a predefined number of iterations through the flow chart, and then is altered to a different, predefined value by the control processor. If the count variable, i, is not greater than the predefined threshold value, T, the control processor returns to step 602 to select a predictive coding mode for the next speech frame. If, on the other hand, the count variable, i, is greater than the predefined threshold value, T, the control processor proceeds to step 610. In step 610 the control processor encodes the next speech frame with a nonpredictive or mildly predictive coding mode. The control processor then returns to step 600, setting the count variable, i, equal to zero again.

Those skilled in the art would recognize that the flow chart of FIG. 7 may be modified to incorporate different recurring patterns of predictively coded and nonpredictively or mildly predictively coded speech frames. For example, the count variable, i, may be varied with each iteration through the flow chart, or after a predefined number of iterations through the flow chart, or pseudo-randomly, or randomly. Or, for example, the next two frames could be encoded with a nonpredictive coding mode or a mildly predictive coding mode in step 610. Or, for example, any predefined number of frames, or randomly selected number of frames, or pseudo-randomly selected number of frames, or a number of frames that varies in a predefined manner with each iteration through the flow chart could be encoded with a nonpredictive coding mode or a mildly predictive coding mode in step 610.

In one embodiment the speech coder 500 of FIG. 6 is a variable-rate speech coder 500 and an average bit rate of the speech coder 500 is advantageously maintained. In a particular embodiment, each predictive coding mode 508, 510 used in the pattern is coded at a different rate than each of the other, and the less-predictive coding mode 512 is coded at a different rate than that used for any of the predictive coding modes 508, 510. In another particular embodiment, the predictive coding modes 508, 510 are coded at relatively low bit rates, and the less-predictive coding mode 512 is coded at a relatively high bit rate. Hence, a high-quality, low-memory or memoryless coding scheme is inserted once every F frames, and medium- to high-quality, heavily predictive, low-bit-rate coding schemes are used between the successive high-bit-rate frames, yielding a reduced average coding rate. While advantageous in any predictive speech coder, this technique is especially useful in low-bit-rate speech coders, in which good voice quality can be achieved only by using heavily predictive coding schemes. Such low-bit-rate speech coders, due to their predictive nature, are more susceptible to corruptions caused by frame errors. By periodically inserting the high-bit-rate, less-predictive coding mode 512 while maintaining the predictive coding modes 508, 510 at various low bit rates, both the desired good voice quality and low average coding rate are achieved.

In one embodiment the average coding rate is advantageously kept constant or nearly constant at a predefined average rate, R, by coding all of the frames in a segment of speech in repeated, deterministic patterns such that the average rate is equal to R. An exemplary pattern is PPN, with P representing a predictively coded frame and N representing a nonpredictively or mildly predictively coded frame. In this pattern the first frame is predictively coded at a of R/2, the second frame is predictively coded at a rate of R/2, and the third frame is nonpredictively or mildly predictively coded at a rate of 2 R. The pattern then repeats, etc. The average coding rate is thus R.

Another exemplary pattern is PPPN. In this pattern the first frame is predictively coded at a rate of R/2, the second frame is predictively coded at a rate of R, the third frame is predictively coded at a rate of R/2, and the fourth frame is nonpredictively or mildly predictively coded at a rate of 2 R. The pattern then repeats, etc. The average coding rate is thus R.

Another exemplary pattern is PPNPPN. In this pattern the first frame is coded at a rate of R/2, the second frame is coded at a rate of R/2, the third frame is coded at a rate of 2 R, the fourth frame is coded at a rate of R/3, the fifth frame is coded at a rate of R/3, and the sixth frame is coded at a rate of 7 R/3. The pattern then repeats, etc. The average coding rate is thus R.

Another exemplary pattern is PPPNPN. In this pattern the first frame is coded at a rate of R/3, the second frame is coded at a rate of R/3, the third frame is coded at a rate of R/3, the fourth frame is coded at a rate of 3 R, the fifth frame is coded at a rate of R/2, and the sixth frame is coded at a rate of 3 R/2. The pattern then repeats, etc. The average coding rate is thus R.

Another exemplary pattern is PPNNPPN. In this pattern the first frame is coded at a rate of R/3, the second frame is coded at a rate of R/3, the third frame is coded at a rate of 2 R, the fourth frame is coded at a rate of 2 R, the fifth frame is coded at a rate of R/2, the sixth frame is coded at a rate of R/2, and the seventh frame is coded at a rate of 4 R/3. The pattern then repeats, etc. The average coding rate is thus R.

Those of skill would understand that any circular rotation of any of the above-described patterns could also be used. Those of skill would also recognize that that the above-described patterns and others could be spliced together in any order, whether randomly or pseudo-randomly chosen, or periodic in nature. Those skilled in the art would further appreciate that any set of coding rates may be used, provided the coding rates average to the desired average coding rate, R, over the duration of the pattern (F frames).

Forcing the frame coded at a high rate to be nonpredictively or mildly predictively coded causes the effects of frame errors to last only as long as the pattern while maintaining a desired average coding rate of R for the segment of speech. In fact, the control processor can be configured to intelligently rotate the pattern to achieve a marginally lower average rate if the segment of speech does not include an exact multiple of F frames, the pattern length. If the desired effective average coding rate, R, for the speech segment was instead achieved by coding all frames in the segment at a fixed rate of R, and the rate R was a relatively low rate to make use of prediction, the speech coder would be extremely vulnerable to the lasting effects of frame error.

Those of skill in the art would understand that although the embodiments described above reside in a variable-rate speech coder, a pattern-based scheme such as those described above could also be employed to advantage in a fixed-rate, predictive speech coder. If the fixed-rate, predictive speech coder were a low-bit-rate speech coder, frame error conditions would adversely affect the speech coder. A nonpredictively coded or mildly predictively coded frame might be of lower quality than predictively coded frames coded at the same low rate. Nevertheless, introducing one nonpredictively coded or mildly predictively coded frame in every F frames would eliminate the effects of frame errors every F frames.

Thus, a novel method and apparatus for using coding scheme selection patterns in a predictive speech coder to reduce sensitivity to frame error conditions has been described. Those of skill in the art would understand that the various illustrative logical blocks and algorithm steps described in connection with the embodiments disclosed herein may be implemented as electronic hardware, computer software, or combinations of both. The various illustrative components, blocks, and steps have been described generally in terms of their functionality. Whether the functionality is implemented as hardware or software depends upon the particular application and design constraints imposed on the overall system. Skilled artisans recognize the interchangeability of hardware and software under these circumstances, and how best to implement the described functionality for each particular application. As examples, the various illustrative logical blocks and algorithm steps described in connection with the embodiments disclosed herein may be implemented or performed with a digital signal processor (DSP), an application specific integrated circuit (ASIC), discrete gate or transistor logic, discrete hardware components such as, e.g., registers and FIFO, a processor executing a set of firmware instructions, or any conventional programmable software module and a processor. The processor may advantageously be a microprocessor, but in the alternative, the processor may be any conventional processor, controller, microcontroller, or state machine. The software module could reside in RAM memory, flash memory, registers, or any other form of writable storage medium known in the art. Those of skill would further appreciate that the data, instructions, commands, information, signals, bits, symbols, and chips that may be referenced throughout the above description are advantageously represented by voltages, currents, electromagnetic waves, magnetic fields or particles, optical fields or particles, or any combination thereof.

Preferred embodiments of the present invention have thus been shown and described. It would be apparent to one of ordinary skill in the art, however, that numerous alterations may be made to the embodiments herein disclosed without departing from the spirit or scope of the invention. Therefore, the present invention is not to be limited except in accordance with the following claims.

What is claimed is:

1. A speech coder, comprising:

at least one predictive coding mode;

at least one less-predictive coding mode; and a processor coupled to the at least one predictive coding mode and to the at least one less-predictive coding mode, the processor being configured to cause successive speech frames to be coded by selected coding modes in accordance with at least one pattern, the at least one pattern including at least one speech frame coded with a less-predictive coding mode.

2. The speech coder of claim 1, wherein the at least one less-predictive coding mode is a mildly predictive coding mode.

3. The speech coder of claim 1, wherein the at least one less-predictive coding mode is a totally nonpredictive coding mode.

4. The speech coder of claim 1, wherein the processor is further configured to implement a predetermined pattern of coded speech frames to maintain an average coding rate.

5. The speech coder of claim 4, wherein a length of the predetermined pattern of coded speech frames is determined in advance from the subjective standpoint of a listener.

6. The speech coder of claim 1, wherein the at least one pattern recurs periodically.

7. The speech coder of claim 1, wherein the at least one pattern comprise a plurality of random patterns.

8. A method of coding speech frames, comprising the steps of:

coding a predefined number of successive speech frames with a predictive coding mode;

coding at least one speech frame with a less-predictive coding mode after performing the step of coding a predefined number of successive speech frames with a predictive coding mode; and repeating the two coding steps in order to generate a plurality of speech frames coded in accordance with a pattern.

9. The method of claim 8, wherein the pattern recurs periodically.

10. The method of claim 8, wherein the pattern is random.

11. The method of claim 8, wherein the less-predictive coding mode is a mildly predictive coding mode.

12. The method of claim 8, wherein the less-predictive coding mode is a totally nonpredictive coding mode.

13. The method of claim 9, further comprising the step of selecting the pattern of coded speech frames to maintain an average coding rate.

14. The method of claim 8, wherein the predefined number of successive speech frames is determined in advance from the subjective standpoint of a listener.

15. The method of claim 8, further comprising the step of changing the predefined number of successive speech frames before the step of repeating the two coding steps.

16. The method of claim 15, wherein the step of changing the predefined number of successive speech frames comprises changing the predefined number of successive speech frames in a periodic manner.

17. The method of claim 15, wherein the step of changing the predefined number of successive speech frames comprises changing the predefined number of successive speech frames in a random manner.

18. A speech coder, comprising:

means for coding a predefined number of successive speech frames with a predictive coding mode;

means for coding at least one speech frame with a less-predictive coding mode after the predefined number of successive speech frames have been coded with the predictive coding mode; and means for generating a plurality of speech frames coded in accordance with a pattern of speech frames encoded with a predictive coding mode and speech frames encoded with a less-predictive mode.

19. The speech coder of claim 18, wherein the pattern recurs periodically.

20. The speech coder of claim 18, wherein the pattern is random.

21. The speech coder of claim 18, wherein the less-predictive coding mode is a mildly predictive coding mode.

22. The speech coder of claim 18, wherein the less-predictive coding mode is a totally nonpredictive coding mode.

23. The speech coder of claim 18, further comprising means selecting the pattern of coded speech frames to maintain an average coding rate.

24. The speech coder of claim 18, wherein the predefined number of successive speech frames is determined in advance from the subjective standpoint of a listener.

25. The speech coder of claim 18, wherein the means for generating the plurality of speech frames is further for changing the predefined number of successive speech frames.

26. The speech coder of claim 25, wherein the means for generating the plurality of speech frames comprises means for changing the predefined number of successive speech frames in a periodic manner.

27. The speech coder of claim 25, wherein the means for generating the plurality of speech frames comprises means for changing the predefined number of successive speech frames in a random manner.

28. A method of coding speech frames, comprising the step of coding a plurality of speech frames in a pattern, the pattern including at least one predictively coded speech frame and at least one less-predictively coded speech frame.

29. The method of claim 28, wherein the pattern recurs periodically.

30. The method of claim 28, wherein the pattern is random.

31. A method of coding speech frames, comprising the step of coding a plurality of speech frames in a pattern, the pattern including at least one heavily predictive coded speech frame and at least one mildly predictive coded speech frame.

32. The method of claim 31, wherein the pattern recurs periodically.

33. The method of claim 31, wherein the pattern is random.

* * * * *